US005921380A

United States Patent [19]

Beck et al.

[11] Patent Number: 5,921,380

[45] Date of Patent: Jul. 13, 1999

[54] CIRCUIT INTERRUPTER WITH COVERED ACCESSORY CASE WITH ACCESSORY HAVING LOCK-IN FEATURE AND PULL TAB

[75] Inventors: H. Richard Beck, Coraopolis; Michael A. Brown, Pittsburgh; Trent A. Chontas, East Pittsburgh; Lance Gula, Clinton; William D. Munsch, Pittsburgh; Karen L. Panian, Renfrew; Robert M. Pomaybo, Beaver; Edward M. Roberts, Pittsburgh, all of Pa.

[73] Assignee: Eaton Corporation, Cleveland, Ohio

[21] Appl. No.: 08/994,633

[22] Filed: Dec. 19, 1997

[51] Int. Cl.[6] ..... H01H 9/02; H01H 13/04

[52] U.S. Cl. ..... 200/307; 335/202

[58] Field of Search ..... 200/17 R, 50.01, 200/50.02, 50.07, 50.1, 50.17, 50.21, 50.23, 50.24, 50.26, 50.27, 293, 296, 297, 307, 318, 321, 322, 332.1, 333, 338; 361/600, 605, 606, 608, 615, 627, 628, 630, 631, 634, 636, 641, 643, 652, 656, 657, 728, 729, 730, 732; 335/78–82, 202

[56] References Cited

U.S. PATENT DOCUMENTS

| | | | |
|---|---|---|---|
| 4,503,408 | 3/1985 | Mrenna et al. | 335/35 |
| 4,595,812 | 6/1986 | Tamaru et al. | 200/307 |
| 4,757,294 | 7/1988 | Todaro et al. | 335/202 |
| 5,001,315 | 3/1991 | Runyan et al. | 200/307 |
| 5,168,137 | 12/1992 | Hufnagel et al. | 200/50 R |
| 5,204,798 | 4/1993 | Scott | 361/93 |
| 5,557,498 | 9/1996 | Dosmo et al. | 361/600 |
| 5,587,570 | 12/1996 | Kelaita, Jr. et al. | 200/50.01 |
| 5,652,420 | 7/1997 | Innes et al. | 200/50.32 |

*Primary Examiner*—Michael A. Friedhofer
*Attorney, Agent, or Firm*—Martin J. Moran

[57] ABSTRACT

A molded case circuit breaker is taught with a housing base and a primary cover disposed on the housing base. The primary cover has a recess therein for an auxiliary module which is disposed in the recess. A secondary cover is disposed on the primary cover for covering the recess when the auxiliary module is disposed therein. In order to secure the auxiliary module underneath the secondary cover in the recess of the primary cover, the module has deposed thereon a locking protrusion which is complimentary with a locking opening in the primary cover. The locking protrusion is flexible and has a longitudinal central bulge so that as the protrusion is pressed inwardly into the opening, the bulge causes the flexible protrusion to reduce diameter due to the presents of longitudinal slots therein until the bulge has passed the opening in which case it springs outwardly toward its normal position thus securing the protrusion in the base. A flexible pull tab is provided for displacement under the auxiliary or secondary cover so that when the auxiliary or secondary cover is removed the pull tab may be tugged upon to remove the module from the primary cover by providing the reverse operation to the insertion operation previously described.

4 Claims, 5 Drawing Sheets

CIRCUIT INTERRUPTER WITH COVERED ACCESSORY CASE WITH ACCESSORY HAVING LOCK-IN FEATURE AND PULL TAB

CROSS REFERENCE TO RELATED APPLICATIONS

The subject matter for this invention is related to co-pending applications: U.S. patent application Ser. No. 08/864,095, (96-PDC-110) entitled "Circuit Interrupter With Plasma Arc Acceleration Chamber And Contact Arm Housing"; U.S. patent application Ser. No. 08/864,141, (95-PDC-369) entitled "Circuit Breaker With Welded Contact Interlock, Gas Sealing Cam Rider And Double Rate Spring", U.S. patent application Ser. No. 08/864,100, (96-PDC-138) entitled "Combined Wire Lead And Interphase Barrier For Power Switches", and U.S. patent application Ser. No. 08/864,104, (96-PDC-547) entitled "Circuit Interrupter with Covered Accessory Case, Adjustable Under Relay, Self-Retaining Collar and One-Piece Rail Attachment".

BACKGROUND OF THE INVENTION

1. Field of the Invention

The subject matter of this invention is related to circuit interrupters generally and more particularly to accessory modules.

2. Description of the Prior Art

The present invention provides an improvement over the invention of U.S. Pat. No. 4,503,408 issued Mar. 5, 1985 to Mrenna et al entitled "Molded Case Circuit Breaker Apparatus Having Trip Bar With Flexible Armor Interconnection" which is assigned at this time to the assignee of the present application and which is incorporated by reference herein. Accessories for molded case circuit breakers have been known for a long time. Generally in the past the accessories have been mounted externally of the internal portion of the circuit breaker. An example of such an accessory is found in U.S. Pat. No. 4,595,812 issued Jun. 17, 1986 to Tamaru et al entitled "Circuit Interrupter With Detachable Optional Accessories". An example of an internally mounted accessory can be found in co-pending application Ser. No. 08/864,104 (96PDC-547).

However, when circuit interruption takes place, the gases generated could tend to propel the accessory away from its static location within the case, thus threatening the structural integrity of the circuit interrupter. It would be advantageous, therefore, if means could be found to secure the module in the housing in a manner which would allow easy removable when desired.

SUMMARY OF THE INVENTION

In accordance with the invention an electrical circuit interrupter has a housing base having a first locking opening therein. A module useful for performing a desirable function is deposed within that housing base. The module has a second locking device which is complimentary with the first locking opening. The first and second locking devices cooperate with each other to secure the module to the housing base. The circuit breaker also has an operating mechanism and first and second main contacts disposed therein for opening and closing. In another embodiment of the invention that housing base has a recess therein, the recess having a locking opening therein. The aforementioned module has a locking protrusion which is complimentary with the locking opening. The other parts of the circuit breaker interrupter are basically the same. In another embodiment of the invention, the locking protrusion is flexible and may contain a longitudinal slot to accommodate flexion. In still another embodiment of the invention, the module may have a tab attached thereto which may be tugged upon to pull the module from the case when it is desired to remove the module. In still another embodiment of the invention, a secondary cover is placed over the module once it is locked in place within the housing base.

DESCRIPTION OF THE PREFERRED EMBODIMENT

Figure 1:
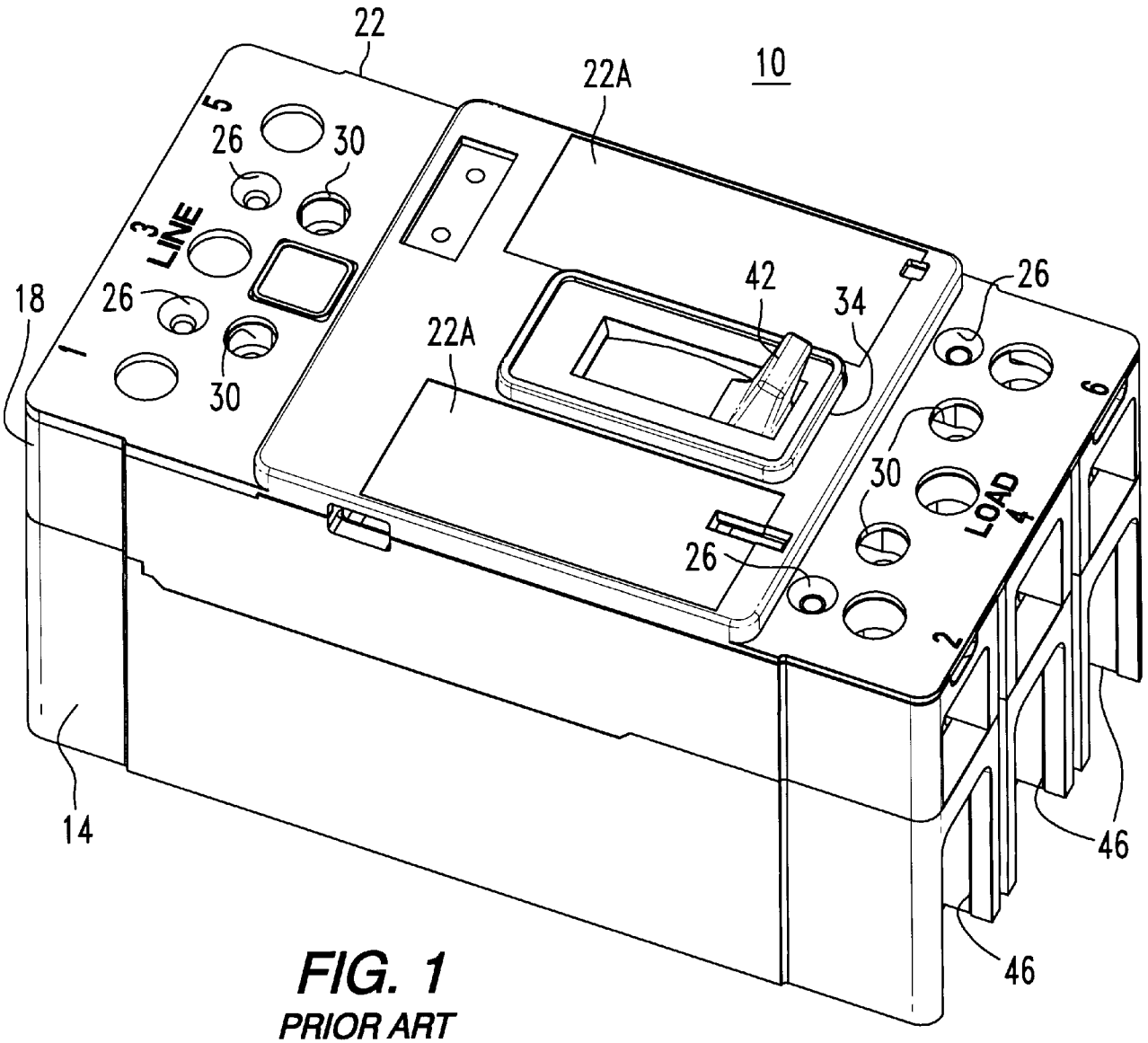
FIG. 1 PRIOR ART
FIG. 1 shows an orthogonal view of a prior art molded case circuit breaker capable of utilizing the teachings of the present invention.
Figure 2:
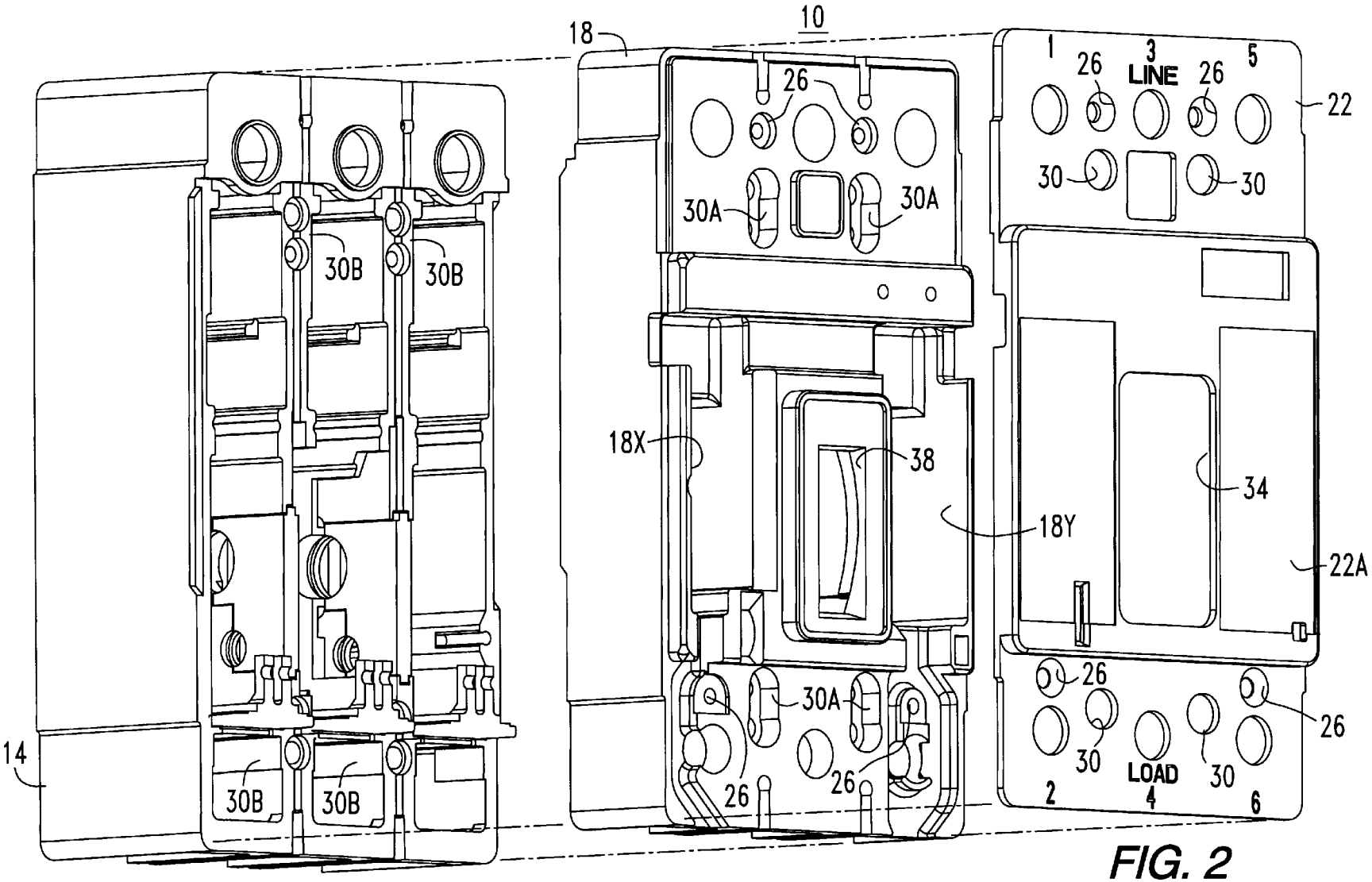
FIG. 2 PRIOR ART
FIG. 2 shows an exploded view of the housing, primary cover and secondary cover of the circuit breaker of FIG. 1.

Referring now to the drawings and FIGS. 1 and 2 in particular, there is shown a prior art molded case circuit breaker 10. Molded case circuit breaker 10 includes a lower base portion 14 mechanically interconnected with a primary cover 18. Disposed on top of the primary cover 18 is an auxiliary or secondary cover 22. The secondary cover 22 may be removed from the circuit breaker rendering some internal portions of the circuit breaker available for maintenance and the like without disassembling the entire circuit breaker. In particular, the secondary cover 22 may shield auxiliary devices or modules such as under-voltage relays, bell alarms, shunt trips and auxiliary switches. Holes or openings 26 are provided in the secondary cover 22 for accepting screws for fastening the auxiliary or secondary cover 22 to the primary cover 18. Additional holes 30 which feed through the auxiliary cover 22, the primary cover 18 and the base 14 are provided for bolting the entire circuit breaker assembly onto a wall, into a DIN rail back panel or into a load center or the like. The primary cover has a recess 18 therein for receiving a drop-in module as will be described hereinafter. The auxiliary cover 22 includes an auxiliary cover handle opening 34. The primary or main cover 18 includes a primary cover handle opening 38. There is provided a handle 42 which protrudes through the aforementioned auxiliary cover handle opening 34 and the primary cover handle opening 38. The handle 42 is utilized in the normal manner to open and close the contacts of the circuit breaker manually and to reset the circuit breaker when it has been tripped. It may also be provided as an indication of the status of the circuit breaker, that is whether the circuit breaker is ON, OFF or TRIPPED disposition.

There are also shown three load conductor openings 46 which shield and protect load terminals 50 (not shown). The circuit breaker depicted is a three-phase circuit breaker. However, the invention is not limited to three-phase operation.

Figure 3:
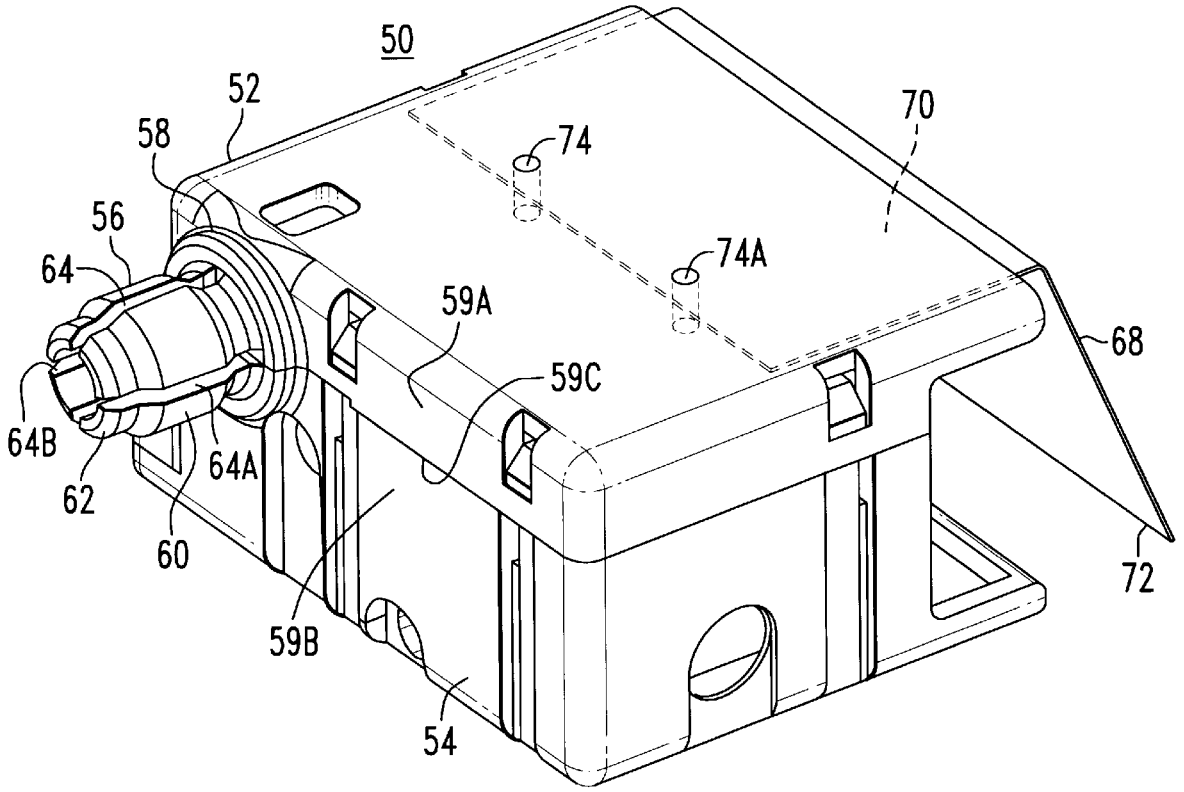
FIG. 3 shows an orthogonal view of a shunt trip module for insertion into the molded case circuit breaker of FIGS. 1 and 2.

Referring now to FIG. 3 there is shown a drop-in module 50. Drop-in module 50 may comprise two or more snap together portions 52 and 54. The bottom most portion of modular element 50 comprises a locking protrusion 56. Locking protrusion 56 may include a widened base 58 which is integral with the bottom portions 59A and 59B of the sections 52 and 54 respectively. There is also provided on the locking protrusion 56 a central locking bulge 60 which tapers downwardly to a leader 62. In one embodiment of the invention the locking protrusion 56 is made flexible to accommodate insertion into a locking opening as will be described hereinafter. The flexibility may be provided by the inherit resiliency of the material of the protrusion 56 and one or more longitudinal slots 64 in the protrusion 56. In this embodiment of the invention there are four non-limiting slots 64, two of which 64A and 64B, roughly align with the dividing line region 59C between the case portion 52 and the case portion 54.

In that manner half of the locking protrusion 56 may be constructed when the module or case portion 52 is being constructed and the other half may be constructed as part of the construction of the modular case portion 54. There may also be provided a pull tab 68 having a region 70 for attachment to the module 50 and a region 72 which may be tugged upon or pulled in order to remove the shunt trip case or module 50 from its locked-in position in the circuit breaker in a manner which will be described hereinafter. Pull tab 68 may be attached to the module 50 by way of holes or opening 74 in region 70 through which protrusions 74A in the section 52 of the module 50 may protrude. In this embodiment of the invention the module 50 represents a case for a shunt trip apparatus of the kind described in co-pending application Ser. No. 08/864,104 (96-PDC-547).

Figure 4:
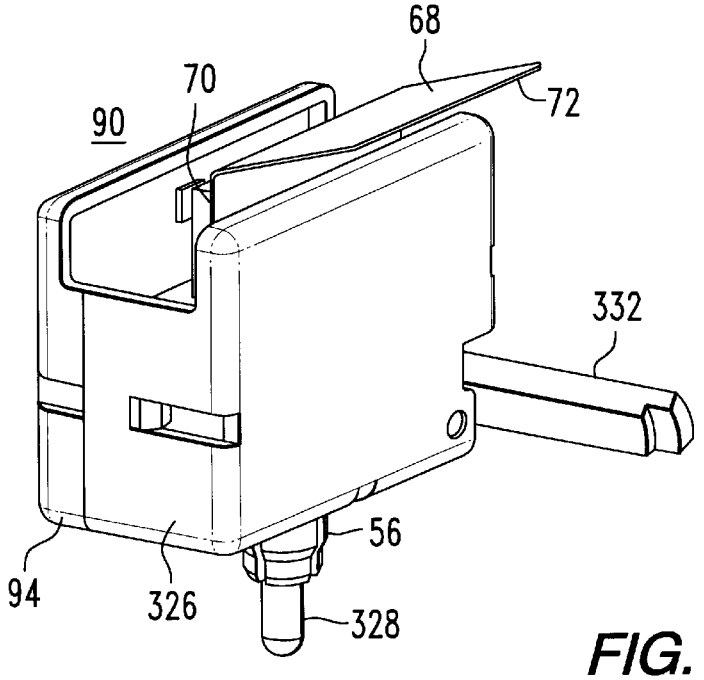
FIG. 4 shows an orthogonal view of a combination auxiliary switch and bell alarm module for insertion into the molded case circuit breaker of FIGS. 1 and 2.

Referring now to FIG. 4 the combination auxiliary switch bell alarm module 90 is depicted. In particular, it may comprise two or more joinable sections 326 and 94 which are joined together to form the module 90 and which are lockably inserted into the circuit breaker 10 a manner which will be described hereinafter. In this embodiment of the invention a pull tab 68, similar to that shown with respect to FIG. 3, having two sections 70 and 72 is also depicted. Pull tab 68 may be conveniently attached to the case 90 in a manner similar to that shown in FIG. 3. The locking protrusion 56 is shown depending from the bottom of the case of the auxiliary module 90. In this embodiment of the invention, locking protrusion 56 may be exactly the same as shown with respect to the module 50 shown in FIG. 3. Protruding there through is an auxiliary switch rider 328 which may move up and down in a manner to be described with respect to the description associated with FIG. 6. As is also described with respect to FIG. 6 a cradle follower 332 which protrudes at a right angle relative to the cam follower 328 from the other side of the enclosure 326 interacts with a bell alarm device 324 as shown in FIG. 4.

Figure 5:
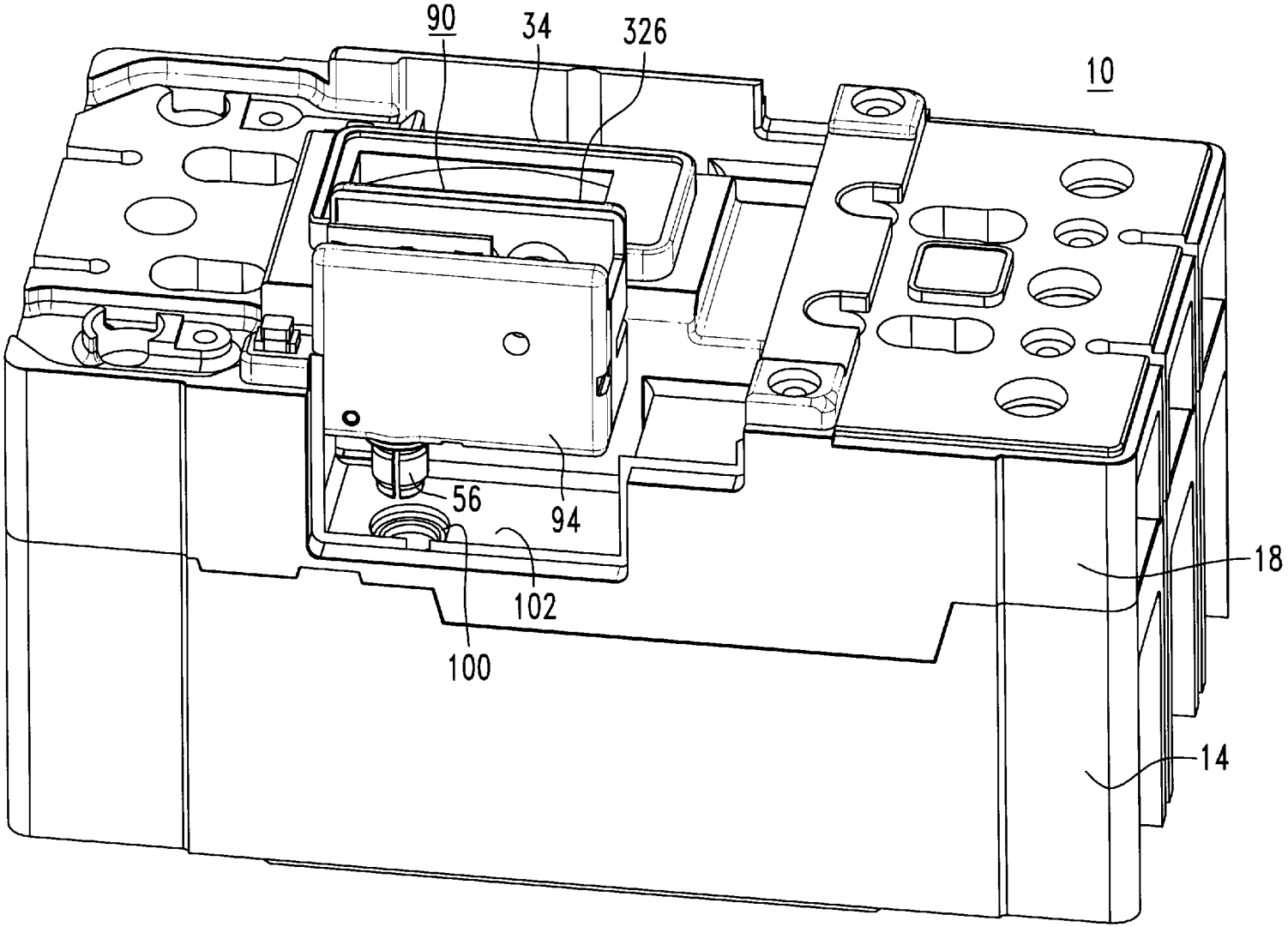
FIG. 5 shows an orthogonal view, partially broken away, of a molded case circuit breaker apparatus similar to that shown in FIGS. 1 and 2 with a portion of an auxiliary module being shown in a disposition immediately prior to insertion into the primary cover of the circuit breaker apparatus for FIGS. 1 and 2.

Referring now to FIG. 5 in conjunction with FIGS. 1, 4 and FIG. 6 which will be described in greater detail hereinafter, the interlocking operation of the module 90 with respect to the circuit breaker 10 is described and depicted. In particular the module 90 is shown with its two sides 94 and 326 as described previously with respect to FIG. 4, but with the cam follower 328 and cradle follower 332 deleted for simplicity. The locking protrusion 56 is clearly shown. Locking protrusion 56 may be insertable into a complimentary locking opening 100 in an intermediate base or floor 102 of the upper circuit breaker case or cover section 18. Once locked into place the module 90 may be disengaged or extracted from the opening 100 by utilization of the tab arrangement 68 shown in FIG. 4, but deleted here for purposes of simplicity of illustration. The case module 90 is pulled upwardly as a result of tugging on its tab 68 so that the flexible protrusion 56 flexes inwardly at the slots or opening 64 to disengage it from the locking opening 100. In the insertion process the tabs of the locking member 56 are depressed or flexed inwardly during the insertion process so that the enlarged region 60 is made circumferentially smaller so that the locking opening 100 may capture the locking protrusion 56 between its enlarged portion 60 and its base portion 68 such as is shown in FIG. 3 for example.

Figure 6:
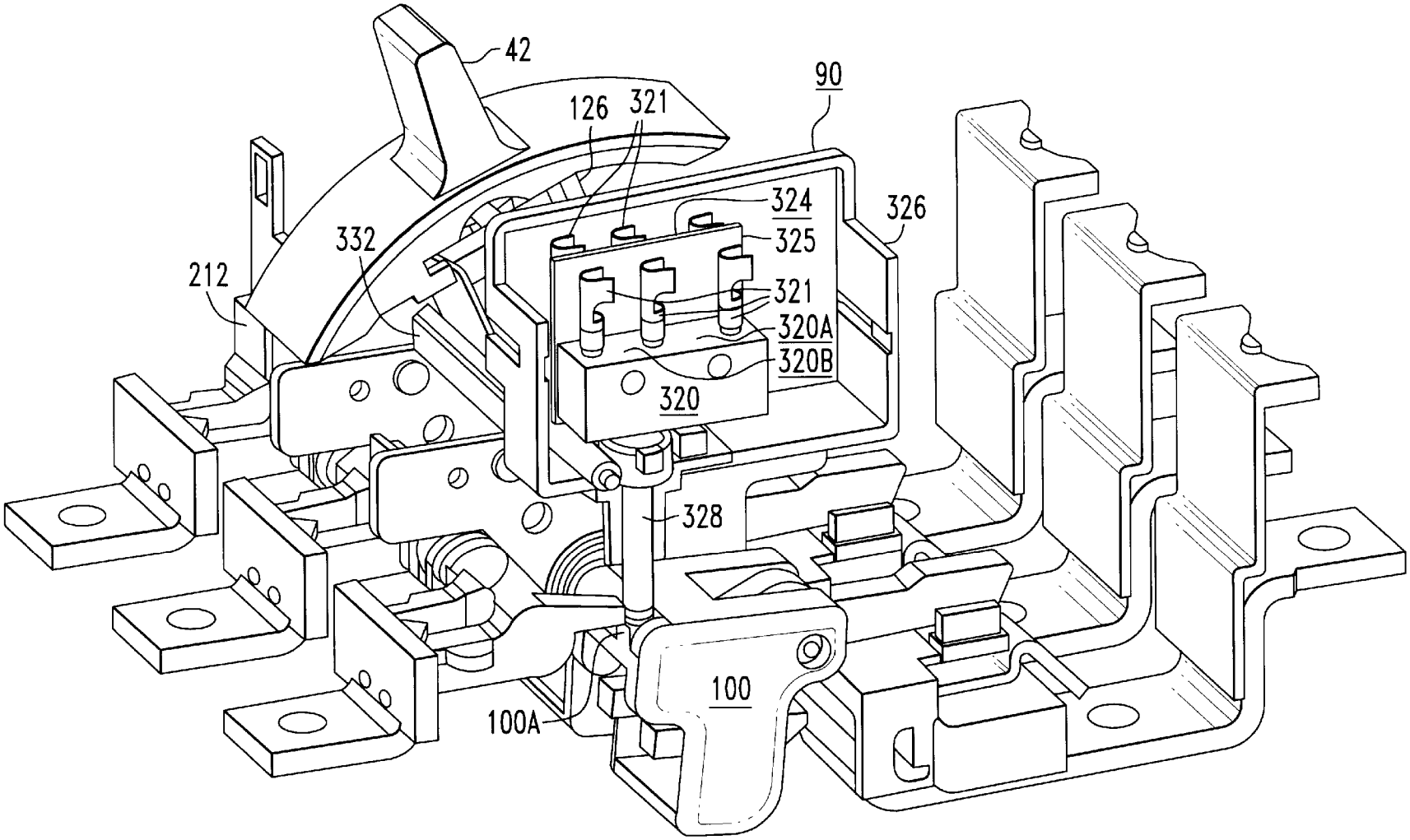
FIG. 6 shows an orthogonal view, partially broken away of an auxiliary switching arrangement for a circuit interrupter which includes the present invention

Referring now to FIG. 6, the disposition of an auxiliary switch 320 and a bell alarm 324 is shown. In particular there is the module 90 shown partially broken away inside of which the auxiliary switch 320 is shown. Alternatively, a pair of auxiliary switches 320 or a pair of bell alarms 324 may be disposed within the enclosure 326 or the disposition of the auxiliary switch 320 and bell alarm 324 may be reversed. The bell alarm 324 is disposed in the same housing 326 on the other side of an insulating auxiliary wall 325. Switch 320 has protruding from the bottom thereof the axially movable cam follower 328 which follows the upper cam surface 100A of a cross bar assembly 100 of the circuit breaker. When the contacts of the circuit breaker are closed, the assembly 100 is in one disposition and when the contacts are open, the assembly is in a second disposition. The difference between the dispositions is tracked by the cam follower 328. The cam follower 328 interconnects with contacts (not shown) in the auxiliary switch 320 such that normally open contact 320A is in one disposition when the contacts are open and in the opposite disposition when the contacts are closed. The complimentary set of contacts 320B are in the opposite dispositions at these times. Appropriate power for causing certain desirable functions as a result of the status and/or change of status of the auxiliary switch 320 may be provided by a set of wires. There is also provided the cradle follower 332 which protrudes at a right angle relative to the cam follower 328 from the other side of the module 90 for interacting with or actuating the bell alarm 324. This arrangement may be used to alert operating personnel that the circuit breaker has tripped and the contacts are opened. Both the auxiliary switch 320 and alarm 324 are contained within one enclosure 326—94 (see FIG. 4) which is independently removable from the circuit breaker mechanism without complete disassembly thereof by removal of the aforementioned secondary or auxiliary cover 22 (not shown) and subsequent removal of the module 90. Insertion of the module 90 may occur in a similar but reverse manner.

It is to be understood with respect to the embodiments of this invention that although the modules 50 and 90, for example, may be utilized to show casings for shunt trip apparatus, auxiliary switches and bell alarms, such cases may be also be used for under voltage relays and the like. In fact there is no limitation to the apparatus which may be disposed within the case depending upon the desirability of the electrical function to be performed and the availability of space.

The apparatus taught with respect to the embodiments of this invention has many advantages. One advantage lies in the fact that the locking arrangement shown herein provides a secure way to affix or maintain an auxiliary module or the like within a circuit breaker case so as to prevent ejection therefrom by the build up of hot gases which may permeate the circuit breaker case under pressure during a circuit interrupting operation. In one embodiment of the invention, were it not for the locking arrangement the gases, which are permitted to reach the accessories due to the conflicting need to seal the breaker yet still permit access to the operating mechanism to actuate the accessories, could propel the module outwardly against the secondary or auxiliary cover 22 shown in FIG. 1, thus perhaps causing damage to the cover or destroying its structural integrity.

What we claim as our invention is:

1. An electrical circuit interrupter, comprising:

a housing base having a recess therein, said recess having a locking opening therein;

a module useful for performing a desirable function disposed within said recess, said module having a locking protrusion which is complementary with said locking opening, said locking protrusion and said locking opening cooperating with each other to secure said module to said housing base;

an operating mechanism disposed within said housing;

first and second main contacts disposed within said housing in a disposition of structural cooperation with said operating mechanism to be opened and closed by said operating mechanism; and wherein said module has a flexible tab depending therefrom which is useful for being pulled to cause said module to be extracted from said locking opening.

2. An electrical circuit interrupter, comprising:

a housing base having a recess therein, said recess having a locking opening therein;

a module useful for performing a desirable function disposed within said recess, said module having a locking protrusion which is complementary with said locking opening, said locking protrusion and said locking opening cooperating with each other to secure said module to said housing base;

an operating mechanism disposed within said housing;

first and second main contacts disposed within said housing in a disposition of structural cooperation with said operating mechanism to be opened and closed by said operating mechanism;

a secondary cover disposed on said housing base for covering said recess when said module is disposed therein; and wherein said module has a flexible tab depending therefrom which is useful for being pulled to cause said module to be extracted from said locking opening.

3. An electrical circuit interrupter, comprising:

a housing base having a recess therein;

a module useful for performing a desirable function disposed within said recess, said module having a flexible tab depending therefrom which is useful for being pulled to cause said module to be extracted from said recess;

an operating mechanism disposed within said housing; and first and second main contacts disposed within said housing in a disposition of structural cooperation with said operating mechanism to be opened and closed by said operating mechanism.

4. An electrical circuit interrupter, comprising:

a housing base having a recess therein;

a module useful for performing a desirable function disposed within said recess, said module having a flexible tab depending therefrom which is useful for being pulled to cause said module to be extracted from said recess;

an operating mechanism disposed within said housing;

first and second main contacts disposed within said housing in a disposition of structural cooperation with said operating mechanism to be opened and closed by said operating mechanism; and a secondary cover disposed on said housing base for covering said recess when said module is disposed therein, said flexible tab allowing said secondary cover to be disposed on said housing base.

* * * * *